United States Patent [19]

Yamaguchi

[11] Patent Number: 4,998,966

[45] Date of Patent: Mar. 12, 1991

[54] SMALL WATERCRAFT

[75] Inventor: Yoshinori Yamaguchi, Moriguchi, Japan

[73] Assignee: Kawasaki Jukogyo Kabushiki Kaisha, Kobe, Japan

[21] Appl. No.: 380,634

[22] Filed: Jul. 14, 1989

[30] Foreign Application Priority Data

Jul. 15, 1988 [JP] Japan ..... 63-177382

[51] Int. Cl.[5] ..... B63B 35/00

[52] U.S. Cl. ..... 114/270; 114/121

[58] Field of Search ..... 114/270, 121; 440/43

[56] References Cited

U.S. PATENT DOCUMENTS 3,426,724 2/1969 Jacobson ..... 114/270
4,760,814 8/1988 Kobayashi ..... 114/270
4,768,453 9/1988 Niina .

FOREIGN PATENT DOCUMENTS 61-244692 10/1986 Japan .

*Primary Examiner*—Joseph F. Peters, Jr.
*Assistant Examiner*—Jesus D. Sotelo
*Attorney, Agent, or Firm*—Marshall, O'Toole, Gerstein, Murray & Bicknell

[57] ABSTRACT

A small watercraft has a hull formed such that the center of buoyancy is slightly aft of the structural center measured in the longitudinal direction of the hull. The craft is equipped with an engine mounted near the center of buoyancy within the hull, and has such auxiliary parts as an oil tank and a muffler which are arranged around the engine. The upper portion of the wall surrounding the engine compartment for the engine may be constructed to protrude upwardly, and a hood with a seat may be mounted over the compartment opening such that the hood can be removed. The joint between the bottom edge of the hood and the upper edge of the surrounding wall of the engine compartment may be located above the draft line of the hull when it is stationary and occupied by the rated number of persons. The fore portion within the hull may be formed into an equipment compartment and a fuel tank compartment, and a hatch cover may be installed over the opening of the equipment compartment so that the cover can be opened and closed by pivoting. The muffler for the engine may be a water muffler through which exhaust gas passes accompanied by engine cooling water, with the fuel tank mounted on the water muffler.

3 Claims, 4 Drawing Sheets

SMALL WATERCRAFT

FIELD AND BACKGROUND OF THE INVENTION

This invention relates to a small recreational watercraft equipped with a jet water propulsion device in the aft portion of the bottom of the hull, which is designed to be maneuvered by an operator using a steering bar installed adjacent the fore portion of the hull.

This type of small watercraft is generally used for leisure sports and is designed to permit an operator to enjoy relatively rough operation, such as quick starts and sharp turns, while maintaining the balance of the craft by adjusting the position of the operator's body. Therefore, since the operator sits adjacent the aft portion of the hull in prior art crafts, the balance of weight in the longitudinal direction of the hull during travel has traditionally been given primary importance. The engine for driving the impellers of the water jet propulsion device has been mounted in the fore portion of the hull, as described in Japanese Pat. Provisional Pub. 61-244692 and U.S. Pat. 4,768,453 of Sept. 6, 1988, for example.

As shown in FIG. 7 of this application, the fore end of the hull of a conventional small watercraft 1' having an engine 10' mounted in the fore portion of the hull, is submerged or sinks below the water line (W.L.) while the aft end of the hull is kept afloat above the water line when no one is aboard. Usually the operator and any passenger mount the small watercraft from the aft end of the hull, and therefore if the aft end of the hull is afloat above the water as mentioned above, it is not easy to get aboard by climbing onto the craft from the water. Also, the difference in the trim (the posture of the craft in the water) between when the operator et al. are aboard and when not is conspicuous because the weight balance in the longitudinal direction of the hull changes greatly by the weight of the operator etc. mounting the aft portion.

Therefore, such a small watercraft cannot offer fully the enjoyment of easy planing operation partly because of the difficulty of getting onto the hull.

Furthermore, due to the relatively long distance between the engine and the water jet propulsion device, a long drive shaft is needed to transmit the driving force from the engine located in the fore portion to the impellers of the water jet propulsion device located in the aft portion. Also, some types of such watercraft require lengthy cooling water piping between the water jet propulsion device and the engine in order to cool the engine. The drive shaft and piping must therefore be long and the structure of the hull (particularly near the drive shaft) is complicated by the arrangement of these parts.

The primary object of this invention is to solve the above-mentioned problems by providing a small watercraft that is easy to board, has less variation in the trim when the operator et al. are on board and when not, that is easy to board from the aft portion, has good stability in the stationary state even when two persons are on board, has excellent acceleration to planing speed, can be easily operated regardless of operator skill, is comfortable to ride, has higher performance regarding sharp turns and quick starts than conventional watercraft, making it easier to enjoy planing, and making it possible to reduce the length of the power train, such as the drive shaft, thus simplifying its construction.

SUMMARY OF THE INVENTION

A small watercraft according to this invention has a hull formed such that the center of buoyancy is slightly aft of the center measured in the longitudinal direction of the hull. The craft is equipped with an engine mounted near the center of buoyancy within the hull, and has such auxiliary parts as an oil tank and a muffler which are arranged around the engine.

The upper portion of the wall surrounding the engine compartment for the engine may be constructed to protrude upwardly, and a hood with a seat may be mounted over the compartment opening such that the hood can be removed; it is desirable that the joint between the bottom edge of the hood and the upper edge of the surrounding wall of the engine compartment be located above the draft line of the hull when it is stationary and occupied by the rated number of persons.

The fore portion within the hull may be formed into an equipment compartment and a fuel tank compartment, and a hatch cover may be installed over the opening of the equipment compartment so that the cover can be opened and closed by pivoting. The muffler for the engine may be a water muffler through which exhaust gas passes accompanied by engine cooling water, with the fuel tank mounted on the water muffler.

A watercraft according to this invention has numerous advantages. The difference in trim of the watercraft is not great between when the operator and any passenger are on board and when they are not; the aft portion of the hull is easy for them to board when nobody is on board; and operation is easy and comfortable because the difference in trim is small between when the craft is stationary and when it is in motion. Besides, thanks to the collective arrangement of the engine, the operator's seat and the auxiliary parts near the center of buoyancy of the hull, the moment of inertia of the craft is smaller than that of conventional small watercraft, so that excellent balance is maintained when turning and/or riding in high waves. Also, rough operations such as sharp turns and quick starts are possible because it has operational performance unique to water jet propulsion crafts. Furthermore, since the engine is located relatively close to the water jet propulsion device, the drive shaft can be short, thereby simplifying the construction. Also, by setting the location of the joint between the lower edge of the hood with the seat and the upper edge of the wall surrounding the engine compartment above the draft line of the hull when the craft is stationary and occupied by the rated number of persons, water is prevented from entering the engine compartment, and therefore the structure of the seal packing at the joint can be simplified.

Further, by forming the fore portion within the hull into an equipment compartment and fuel tank compartment, and by installing a hatch cover over the opening of the equipment compartment that can be opened and closed by pivoting, the hatch cover can be opened to stow equipment and to check the fuel level in the fuel tank.

Still further, by using for the muffler a water muffler through which exhaust gas passes accompanied by engine cooling water, and by mounting the oil tank on this water muffler, limited engine compartment space can be utilized effectively.

BRIEF DESCRIPTION OF THE DRAWINGS

The invention will be better understood from the following detailed description taken in connection with the accompanying drawings in which.

DETAILED DESCRIPTION OF THE DRAWINGS

Figure 1:
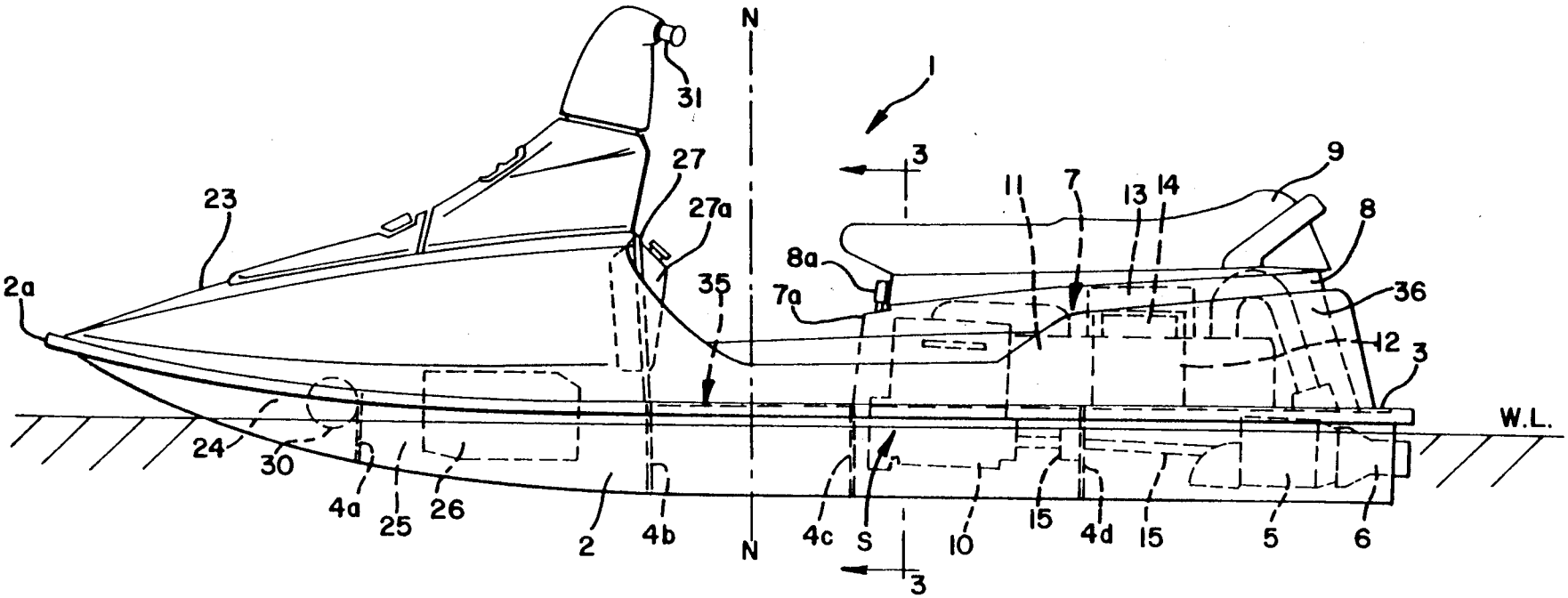
FIG. 1 is a side view of a small watercraft according to this invention.
Figure 2:
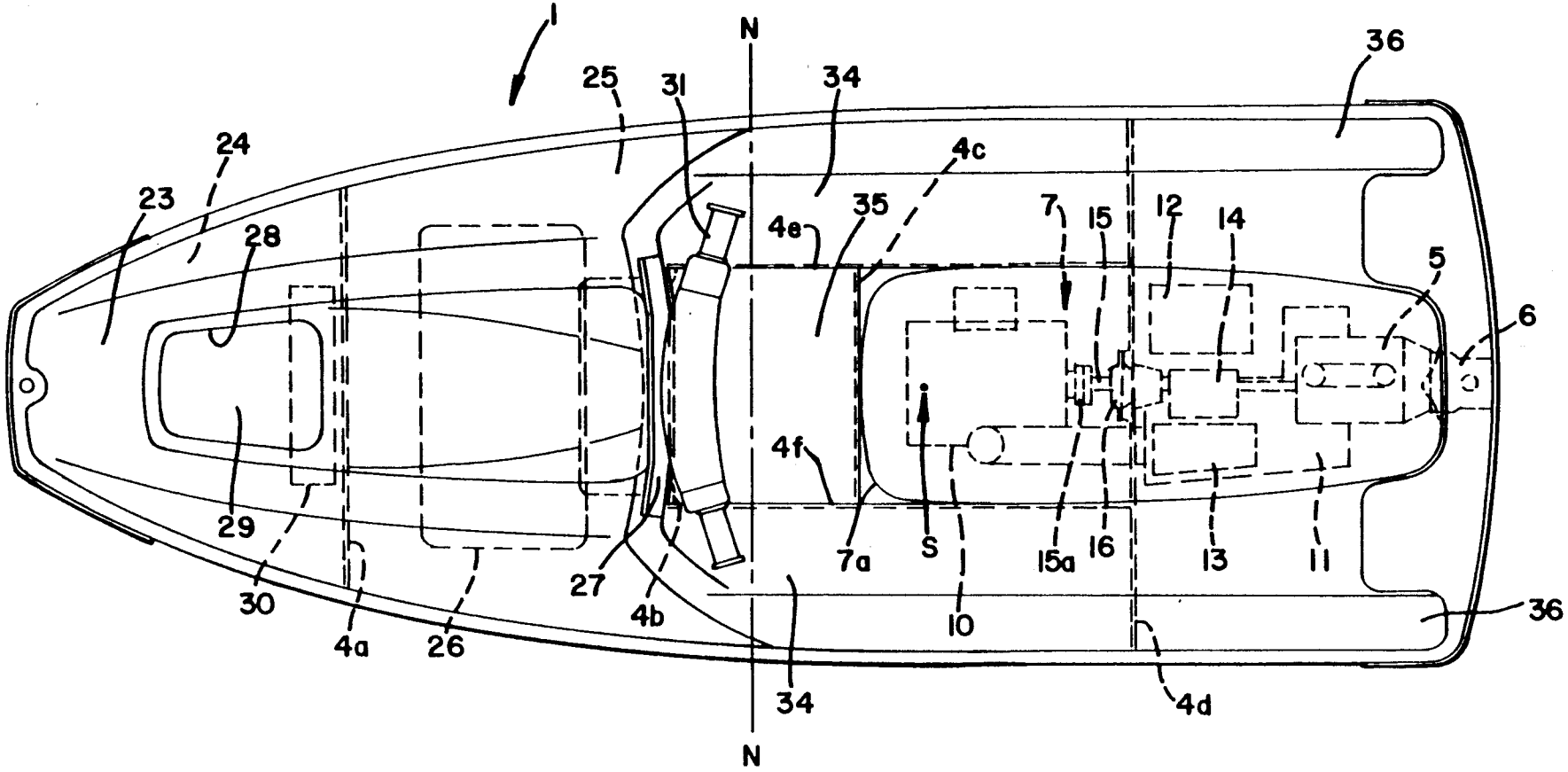
FIG. 2 is a plan of the craft.

As shown in FIGS. 1 and 2, the watercraft 1 is relatively broad and the center of buoyancy S is slightly aft of the structural center N measured in the longitudinal direction, when no one is aboard and when the craft is stationary in the water. The craft is shown in FIG. 1 at rest in the water which forms a water line W.L. The craft includes a lower hull 2 and an upper deck 3 which are solidly joined along a peripheral flange 2*a*.

The inside of the hull 2 is divided by multiple laterally extending bulkheads 4*a* to 4*d* in the longitudinal direction and by longitudinally extending bulkheads 4*e* and 4*f* in the lateral direction. The aft end or stern of the hull 2 is provided with a water jet propulsion device 5, at the aft end of which is a steering nozzle 6.

Figure 3:
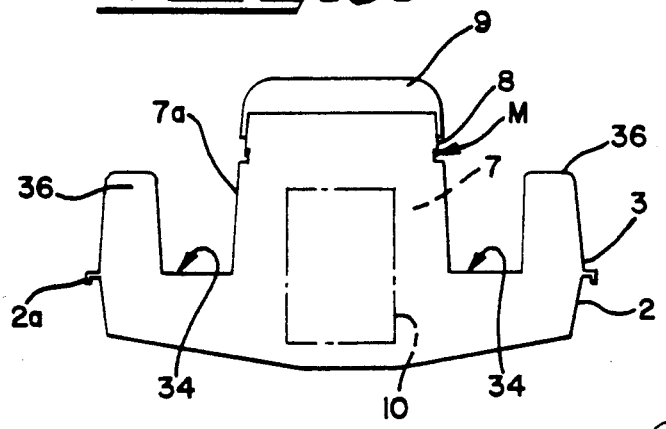
FIG. 3 is a simplified cross-sectional view taken on the line 3—3 in FIG. 1.

An engine compartment 7 is formed along the longitudinal center line of the craft between the lower hull 2 and the rear part of the deck 3. As shown in FIG. 3, the upper portion of the deck surrounding wall 7*a* forming the engine compartment 7 protrudes upwardly. As shown in FIGS. 2 and 3, a footrest/step 34 is formed on the deck 3 on each side of the engine compartment 7. Each side of the deck 3 is formed into a fin 36 protruding upwardly outside of the step 34. The top of the wall 7*a* of the engine compartment 7 is open. As shown in FIGS. 1 and 3, the top opening of the wall 7*a* is provided with a rear hood or cap 8 that can be attached and detached from the wall 7*a*, the hood 8 being open on its bottom side and equipped with a tandem seat or cushion 9 on its upper side. The rear hood 8 is designed to be secured in place on the wall 7*a* by a fixture 8*a* at the front of the hood 8 (FIG. 1). Although not shown, a seal packing is preferably secured around either the upper edge of the surrounding wall 7*a* of the engine compartment 7 or the lower edge of the rear hood 8 in order to prevent water from entering the compartment 7.

Figure 4:
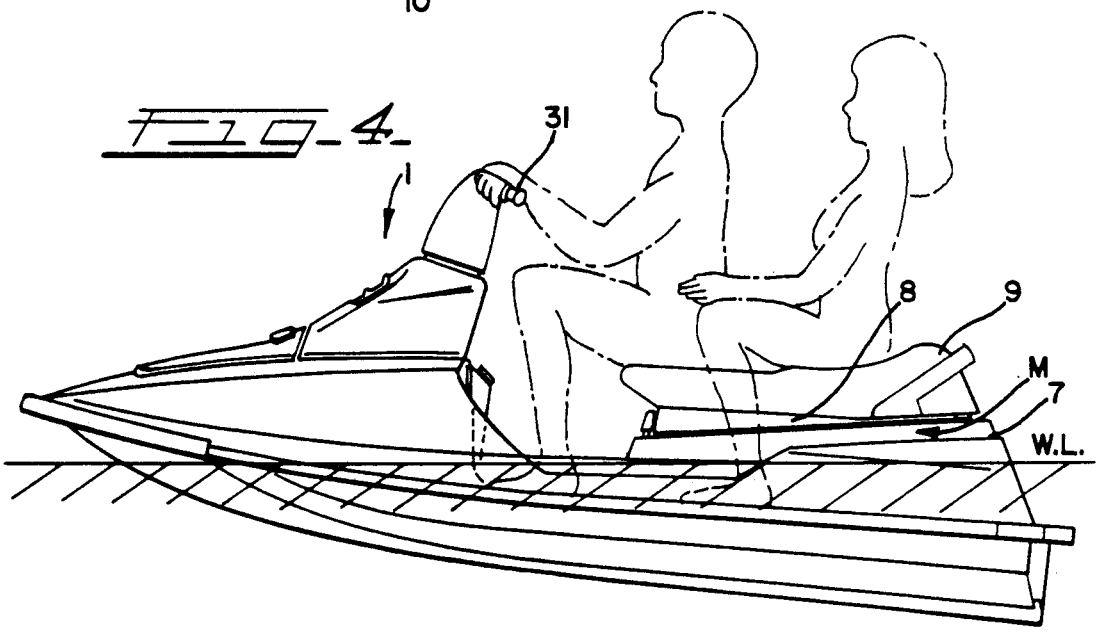
FIG. 4 is a side view of the craft when stationary and occupied by two persons.

As shown in FIG. 4, the location of the joint between the upper edge of the surrounding wall 7*a* of the engine compartment 7 and the lower edge of the hood 8 is set above the draft or water line W.L. of the hull when the craft is stationary and occupied by the rated number (two in this instance) of persons, so that the joint M is not submerged in the water in the normal state (stationary or moving).

Figure 7:
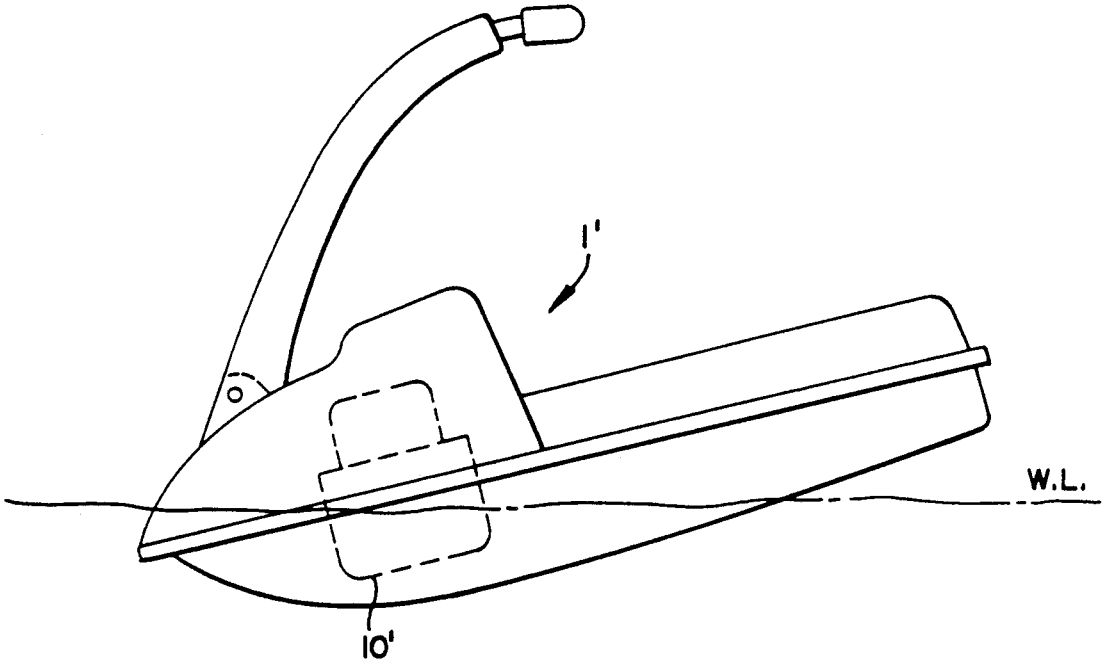
FIG. 7 is a side view of a prior art small watercraft in the water with no one on board.

As shown in FIGS. 1 and 2, and as one feature of this invention, an engine 10 is mounted approximately at the center of buoyancy S of the watercraft 1 when stationary on the water with nobody aboard and on the longitudinal center line of the craft. In other words, by placing the engine 10, which is the heaviest unit on board, close to the center of buoyancy S in the fore part of the interior of the engine compartment 7, balance will be achieved of the watercraft 1 by itself. In the conventional watercraft 1′ (FIG. 7) equipped with an engine 10′ in the fore portion of the hull, the balance of the watercraft is maintained by the weight of the operator who is at the aft portion together with that of the remainder of the craft. Therefore the prior art craft requires an operator for balance.

In the engine compartment 7, a water muffler 11 and a battery 12 (FIG. 2) are placed side by side just behind the engine 10, and an oil tank 13 and a box 14 containing electrical parts (not shown) for the engine are mounted on the water muffler 11. As shown in FIG. 2, the battery 12 is on one side of the longitudinal center line, and the muffler 11, the oil tank 13 and the majority of the box 14 are on the other side of the longitudinal center line. Along with such an advantageous location of the engine 10, the collective arrangement of such auxiliary parts including the parts 11 to 14 around the engine 10 helps improve the balance of the watercraft 1. The engine 10 and the impellers (not shown) of the water jet propulsion device 5 are connected by a drive shaft 15 through a coupling 15*a*. The drive shaft 15 is journalled by a bearing 16 mounted on the most rearward bulkhead 4*d*. The engine 10 is mounted in the enclosure formed between the bulkheads 4*c*, 4*d*, 4*e* and 4*f*.

Figure 6:
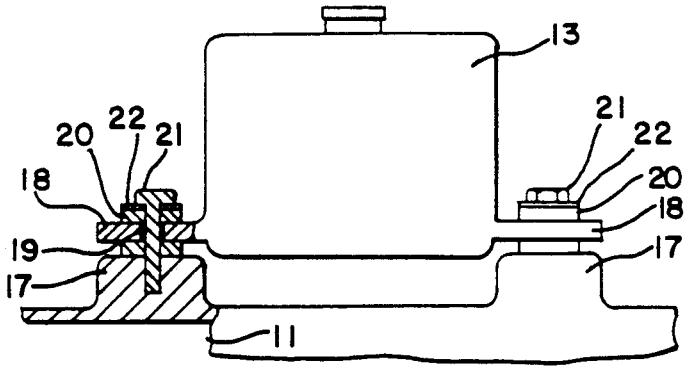
FIG. 6 is an enlarged cross-sectional view taken on the line 6—6 in FIG. 5.

The water muffler 11 is a prior art type generally used in this kind of watercraft 1. It is designed so that the cooling water of the engine 10 is partially discharged into the exhaust gas channel and the exhaust gas accompanied by the cooling water passes through the muffler 11. Therefore, the temperature of the water muffler when the engine 10 is running does not rise so high as that of usual mufflers. This makes it possible to place the oil tank 13 and the electrical parts box 14 on the muffler 11. As shown in FIG. 6, four fixing bolt seats or bosses 17 protrude from the top side of the muffler 11 to facilitate fixing the tank 13 to the muffler 11, which is fixed by bolts 21 with washers 22 through heat-resistant rubber dampers 20 and holes 19 of flanges 18 provided at the bottom of both sides of the tank 13. Such an arrangement allows a clearance between the muffler 11 and the tank 13, and heat flow from the muffler is insulated by the damper 20; therefore the heat from the muffler 11 is not transmitted directly to the tank 13.

Figure 5:
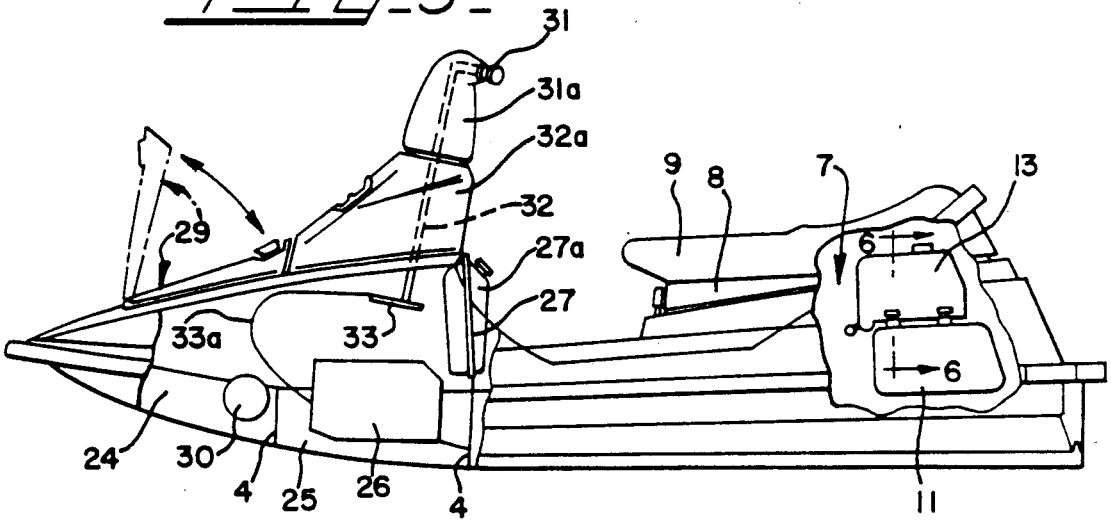
FIG. 5 is a side view of the craft with parts broken away to show underlying parts.

In FIGS. 1 and 2, in the fore portion from the center N (measured in the longitudinal direction) of the watercraft 1, a front hood 23 is solidly joined to and covers the fore portion of the hull 2, inside which are formed an equipment compartment 24 and a fuel tank compartment 25 behind it. The lower parts of the compartments 24 and 25 are separated by the most forward cross bulkhead 4*a*. The fuel tank 26 is placed in the compartment 25, the rear end of which is blocked by the cross bulkhead 4*b* and a vertical bulkhead 27 which extends upwardly from the bulkhead 4*b*. A receptacle 27*a* with a lid is provided in the central portion of the bulkhead 27 to contain various things. The front hood 23 above the equipment compartment 24 has an opening 28 shown in FIG. 2. As shown in FIG. 5, one edge of a hatch cover 29 is pivotally attached to the front end of the opening 28, and the cover 29 can be opened upwardly at the front of the watercraft 1. With the hatch cover 29 opened, the amount of fuel remaining in the fuel tank 26 can be confirmed from the aperture 28. A fire extinguisher 30 is preferably installed in the equipment compartment 24.

As shown in FIG. 5, a steering shaft 32 is journalled for rotation on a generally vertical axis in the middle of the rear end portion of the upper wall of the front hood 23. A bar handle 31 is fixed at the upper end of the steering shaft 32 for rotating the shaft 32. When the bar handle 31 is maneuvered by the operator, the steering nozzle 6 (FIG. 1) connected to an operating member 33 at the lower end of the steering shaft 32 through a push cable 33*a* is swung horizontally to steer the watercraft 1. Foaming synthetic resin 31*a* and 32*a* (FIG. 5) is placed around the bar handle 31 and the steering shaft 32 so as to produce buoyancy.

Behind the bar handle 31, as shown in FIGS. 1 and 2, a step 35 of the step-through (scooter) type is provided between the bulkhead 27 and the front surface of the surrounding wall 7*a* of the engine compartment 7, so that the operator sitting in the seat 9 can stretch his/her legs. This step 35 is connected to the steps 34 on both the right and left.

In use, the operator and the passenger, who usually board the craft from the water, get onto the deck 3 from the aft end of the watercraft. Even before they get on, the watercraft stays afloat in an almost horizontal posture on the surface of the water as shown in FIG. 1, because the engine 10 and the auxiliary parts 11–14 are arranged near the center of buoyancy S and the fuel tank 26 is located substantially forwardly of the center S. Therefore, the operator etc. can easily board the watercraft 1.

Even after the operator and any passenger have boarded the watercraft 1 and are seated on the seat 9, the change of trim (posture) is as small as the extent at which the craft or water line W.L. of the watercraft 1 rises slightly as shown in FIG. 4. In this state, the operator revs up the engine 10 to move the watercraft 1, while steering by holding the bar handle 31 in front of the seat 9 with both hands and moving the steering nozzle 6 (FIG. 1) to the right or left. The time required for the craft to start moving, i.e. the accelerating ability, depends on the intensity of the hump resistance, and is affected by the trim when the craft is stationary. According to this invention, the trim is almost unchanged whether the craft has one person or two aboard, and so it has excellent performance in terms of acceleration and ease of operation. Although the fuel tank 26 is placed slightly ahead of the center N of the watercraft 1, hardly any change occurs in the trim of the watercraft 1 even if the fuel level in the tank 26 varies, because the engine 10 and auxiliary parts 11–14 are collectively arranged near the center of buoyancy S (FIGS. 1 and 2) as described above.

This invention may apply to a one-seater small watercraft in addition to the two-seater craft shown in the drawings. Instead of the step-through type, the craft may be the conventional step type in which the operator sits astride the seat.

The watercraft of this invention has such effects as mentioned below.

The variation in trim between when the operator and any passenger are on board and when not is reduced by installing the engine near the center of buoyancy in the hull as well as by collectively arranging the operator's seat and auxiliary parts such as the oil tank, muffler, etc. around the engine. This facilitates boarding at the aft portion of the craft, brings about better stability when the craft is stationary even with two persons aboard, and improves acceleration. Also, the moment of inertia is so small that the watercraft is subject to less rolling and pitching even in rough waves, making it comfortable to ride; that the craft can be easily righted after overturning, easily operated without extensive operator's skill or experience, with higher performance regarding sharp turns and quick starts than the conventional small watercraft, allowing one to enjoy to the fullest extent the experience of moving on the water. Furthermore, the short distance between the engine and the water jet propulsion device makes it possible to reduce the length of the power train, especially the drive shaft, and simplify the hull structure around it.

Furthermore, maintenance can be easily performed by removing the hood 8 with seat 9, checking inside the engine compartment and supplying oil from the aperture at the upper end of the engine. In addition, in the normal state, water is prevented from entering at the joint between the lower edge of the hood with the seat and the upper edge of the wall surrounding the engine compartment. Also the structure of the seal packing for this joint can be simplified, making it possible to use seals of lower precision.

In addition, the hatch cover can be opened to store equipment and, at the same time, check the amount of fuel left in the fuel tank. The engine and auxiliary parts can be housed efficiently in the limited space of the engine compartment.

What is claimed is:

1. A watercraft comprising a hull having fore and aft portions, a water jet propulsion device mounted in said aft portion of the hull, a steering bar installed in the fore portion of the hull and connected to adjust said propulsion device, said hull being shaped such that the center of buoyancy is slightly aft of the center in the longitudinal direction of the hull, an engine mounted within the hull adjacent said center of buoyancy, auxiliary parts including an oil tank and a muffler being collectively arranged around said engine, said hull including a surrounding wall forming an engine compartment for said engine and said wall protruding upwardly and forming an opening for said engine compartment, a hood with a seat placed removably over said opening of said engine compartment, and the location where the lower edge of said hood and the upper edge of the surrounding wall of said engine compartment are joined being located above the draft line of said hull when the watercraft is stationary in the water and is occupied by the rated number of persons.

2. A watercraft as set forth in claim 1, wherein said fore portion within the said hull is formed into an equipment compartment and a fuel tank compartment, an opening being provided at the top of said equipment compartment, and a hatch cover being mounted to said hull adjacent said opening so as to be opened and closed by pivoting.

3. A watercraft comprising a hull having fore and aft portions, a water jet propulsion device mounted in said aft portion of the hull, a steering bar installed in the fore portion of the hull and connected to adjust said propulsion device, said hull being shaped such that the center of buoyancy is slightly aft of the center in the longitudinal direction of the hull, an engine mounted within the hull adjacent said center of buoyancy, and auxiliary parts including an oil tank and a muffler being collectively arranged around said engine, said muffler comprising a water muffler through which exhaust gas passes accompanied by engine cooling water, and said oil tank being mounted on top of said water muffler.

* * * * *